United States Patent [19]

Ikeuchi et al.

[11] 4,421,846

[45] Dec. 20, 1983

[54] PHOTOGRAPHIC ELEMENT WITH REDUCIBLE METAL COMPLEX THAT RELEASES PHOTOGRAPHICALLY USEFUL COMPOUND

[75] Inventors: Satoru Ikeuchi, Hino; Masaru Kanbe, Hachioji; Jiro Takahashi, Hachioji; Ryuichiro Kobayashi, Hachioji; Shunji Suginaka, Tokyo; Noboru Mizukura, Tsukui, all of Japan

[73] Assignee: Konishiroku Photo Industry Co., Ltd., Tokyo, Japan

[21] Appl. No.: 333,901

[22] Filed: Dec. 23, 1981

[30] Foreign Application Priority Data

Dec. 23, 1980 [JP] Japan ..... 55-183573

[51] Int. Cl.[3] ..... G03C 5/54; G03C 1/10; G03C 1/40; G03C 1/06

[52] U.S. Cl. ..... 430/559; 430/212; 430/218; 430/219; 430/223; 430/447; 430/542; 430/564; 430/566; 430/612; 430/621; 430/936

[58] Field of Search ..... 430/212, 218, 219, 223, 430/447, 479, 936, 957, 958, 959, 960, 566, 541, 559, 564, 612, 621, 542

[56] References Cited

U.S. PATENT DOCUMENTS

| | | | |
|---|---|---|---|
| 3,295,978 | 1/1967 | Barr | 430/959 |
| 4,002,477 | 1/1977 | Bissonette | 430/218 |
| 4,097,278 | 6/1978 | Bissonette | 430/223 |
| 4,124,392 | 11/1978 | Adin et al. | 430/936 |
| 4,239,848 | 12/1980 | Adin et al. | 430/936 |
| 4,324,852 | 4/1982 | Adin et al. | 430/936 |

*Primary Examiner*—Richard L. Schilling
*Attorney, Agent, or Firm*—Finnegan, Henderson, Farabow, Garrett & Dunner

[57] ABSTRACT

A photographic element containing a nondiffusible metal complex capable of releasing a diffusible photographically useful group. The complex contains at least one poly-dentate ligand which contains the photographically useful group. The complex may be activated when reduced under alkaline conditions to release the photographically useful group.

17 Claims, No Drawings

PHOTOGRAPHIC ELEMENT WITH REDUCIBLE METAL COMPLEX THAT RELEASES PHOTOGRAPHICALLY USEFUL COMPOUND

The present invention relates to a photographic element and more specifically to a photographic element which comprises a nondiffusible complex capable of releasing a diffusible photographically useful substance.

Various types of photographic processes in which a complex is used are known. A first example of such process is the so-called "oxidation redox cobalt process". In this process, the oxidizing potential of a $Co^{(III)}$ complex ion is utilized to amplify dye image formation. That is to say, in exposed areas, the $Co^{(III)}$ complex reacts with a color developing agent under the catalytic action of an imagewise distributed silver image to ultimately produce a dye in increased quantities as compared with an ordinary developing process.

A second example is the so-called "cobalt complex salt photographic process". In this process, the photographic element comprises both a $Co^{(III)}$ complex and a photoreducing agent which is capable of, under exposure to light, being converted into a reducing agent which can reduce such $Co^{(III)}$ complex into a $Co^{(II)}$ ion. In the cobalt complex salt photographic process, as disclosed in Japanese Patent Publications Open to Public Inspection (hereinafter referred to as Japanese Patent O.P.I. Publication) No. 139722/1975, 139723/1975 and 139724/1975, the $Co^{(III)}$ complex is reduced in exposed areas to form $Co^{(II)}$ ion and ammonia. As a picture recording system, (1) the $Co^{(II)}$ ion and (2) ammonia released in the exposed areas make use of (3) the remaining $Co^{(III)}$ complex in the picture formation.

Further, as a picture recording system making use of a ligand from such complex, two processes have been proposed; (i) one using such a kind of dye as a pyrylium compound that changes its color as it is bleached under contact with ammonia to a practically colorless (transparent) form, and (ii) the other using such a compound as a phthalaldehyde or a ninhydrin that gets colored under contact with ammonia.

In these system heat is utilized for development and recording, and the reduction of the complex is facilitated by heat, thereby to release a ligand. In other words, the reduction of the cobalt complex and the release of ligand require heating (approximately between 85° or 150°) and as the complex is reduced by such heating, the ligand is released and evaporated to reach a image receiving element where the dye image formation takes place. These systems thus have a disadvantage in that the image formation process cannot be carried out at room temperature.

A third example is a process which makes use of a metal complex of certain dyes as disclosed in Japanese Patent Examined Publication No. 7872/1960. The dye-metal complexes used in this system are insoluble in alkaline solution and can be reduced by the silver halide developing agent to give a dye which is soluble in the alkaline composition. As an example of this kind, a copper complex of O,O'-dihydroxyazo dyes can be mentioned. In these dye-metal complexes, however, a dye molecule or molecules are directly coordinate bonded to a central metal ion to form a metal-chelated dye, so these complexes have disadvantage in that in order to form a stable metal complex only those dyes which contain a plurality of chelatable groups can suitably be used. Further, since such metal-chelated dyes as cited above comprise a dye-containing ligand that is activated for exchange at the non-reduced state, these dyes have another disadvantage in that if they are used as an image forming substance together with a silver halide emulsion, color development is likely to take place even in unexposed areas and cause colored background or stains.

Accordingly, a primary object of the present invention is to provide a photographic element which comprises a new nondiffusible complex which is capable of releasing a diffusible photographically useful substance.

Another object of the present invention is to provide a photographic element which comprises a new nondiffusible complex which is stable in the element and is capable of releasing a diffusible photographically useful group.

Still another object of the present invention is to provide a photographic element which comprises a nondiffusible complex which is capable of efficiently releasing one or more photographically useful groups by the use of an electron.

The present invention, therefore, specifically relates to a photographic element which comprises a photosensitive silver halide emulsion layer on a support, and a metal complex which is nondiffusible, inert with respect to ligand exchange and has at least one polydendate group containing a photographically useful group which is of itself diffusible when released from the complex, the complex being capable of being activated when reduced in alkaline condition to become labile, with respect to ligand exchange, to release the photographically useful group.

Although the mechanism of release of the photographically useful group from the complex is not yet clear, one likely hypothesis is that the central metal ion in the complex is reduced through an electron transfer reaction that converts the complex from an inert state into a labile state with respect to ligand exchange, thereby facilitating the ligand exchange reaction between a ligand containing a photographically useful group and another ligand (for example, aqua molecule), resulting in quick cleavage of the coordinate bond between the metal ion and the ligand containing the photographically useful group.

The nondiffusibility of the complex in the alkaline condition is partially due to the molecular size of such complex, so as the result of the cleavage of the coordinate bond the photographically useful group becomes diffusible.

In areas where the electron transfer reaction toward the complex does not occur, however, the ligand exchange reaction takes place at such a slow rate that the ligand containing the photographically useful groups remains substantially unexchanged, remaining stable at its original site.

The coordination of ligands to the metal ion may be explained by the Lewis' acid-base reaction, and the more acidic the metal or the more basic is the ligand, the more stable is the complex formed. For example, the transition metal ions are fairly strong Lewis acids and the complexes thereof are fairly stable, while the alkali metal ions are weak Lewis acids, and their complex are almost unstable.

Complexes are grossly classified into two types on the basis of the rate of their ligand exchange reaction. According to Taube, the ligand exchange labile complex is defined as a type that has such a fast rate of ligand exchange reaction that the ligand exchange occurs almost as soon as a ligand substance is added. On the other hand, the ligand exchange inert complex is defined as a type which is practically free of any ligand exchange when the complex dissolved in an inert solvent at a predetermined concentration and the same substance as the ligand of the compelx is dissolved at the same concentration. Taube specified actual concentration and time data for the criteria for distinction between these two types.

As regards the complex, the valence bond theory, ligand field theory, etc. are used for its explanation. According to the explanation based on the valence bond theory, complexes are classified into two types, i.e. outer orbital complex and inner orbital complexes depending on the type of d orbitals involved in the complex formation. An outer orbital complex, such as occurs in $[Sn.(NH_3)_6]^{2+}$, has the 4d orbitals at a energy level low enough for the formation of valence bonds, so that orbitals are involved in such bonds. A common complex $[Co(NH_3)_6]^{3+}$ and other complexes in which the 3d orbitals are involved in the formation of valence bonds are called the inner orbital complex. Outer orbital complexes are ligand exchange-labile complexes, while inner orbital complexes are divided into ligand exchange-labile complexes and ligand exchange-inert complexes.

According to the Taube's classification as reported in Chem. Rev. 52, 69 (1952), octahedral inner orbital complexes show pronounced correlation between the electron configuration and the rate of ligand exchange reaction. Namely, an inner orbital complex is ligand exchange-labile when one or more inner d orbitals are vacant while it is ligand exchange-inactive when there is no vacant inner d orbital.

Therefore, ligand exchange-inert complexes are inner orbital complexes having a coordination number of 6 without any vacant inner d orbital.

According to this classification, certain metal complexes can either be a ligand exchange-labile or a ligand exchange-inert type depending on the oxidized state of the metal.

Generally, stability of a metal complex increases as the central metal is more electrically charged, and, therefore, many ligand exchange-labile type complexes are of less oxidized state and many ligand exchange-inert complexes are vice versa, although there are some exceptions as in complexes of $Mo^{(III)}$ and $W^{(III)}$ which are inert with respect to ligand exchange when they are in less oxidized state.

Accordingly, it is possible for certain metal complexes, which are inert with respect to ligand exchange reaction in one oxidized state, to cause a ligand exchange reaction when its oxidized state is changed, mostly from its more oxidized state to its less oxidized state by reduction.

Those metal complexes which can be activated in their ligand exchange reaction by reduction are called as "Metal Complex Ligand Exchange Redox Compounds" or, simply, "CLER Compounds".

Metal complexes referred to in the present invention more particularly relates to this "CLER compound". Complex Ligand Exchange Redox Compounds or, simply, "CLER Compounds".

Metal complexes referred to in the present invention, more particularly, relates to this "CLER compound".

In the present invention, the term "ligand exchange-labile complex" is used in the meaning that the complex can be activated for ligand exchange reaction under alkaline condition, in which half-value-rate ($t_{\frac{1}{2}}$), necessary time for one half of ligands in the original complex to exchange, is less than 2 minutes, thereby to cause release of a photographically useful group. On the contrary, the term "ligand exchange-inert complex" is used, in the present invention, in the meaning that half-value-rate of such complex is more than 2 minutes, and such complex substantially does not cause ligand exchange under alkaline condition.

In the present invention, more preferable ligand exchange labile complexes are those whose half-value-rate is not more than 50 seconds.

The most preferable ligand exchange inert complexes utilized in the present invention are $Co^{(III)}$ complexes.

Most $Co^{(III)}$ complexes are a stable ligand exchange-inert complex, while $Co^{(II)}$ complexes are mostly labile with respect to ligand exchange. Thus when a $Co^{(III)}$ complex containing ligands having a photographically useful group is reduced to a $Co^{(II)}$ complex, the ligand exchange reaction takes place within fairly a short period of time and thereby the photographically useful group is released.

Further it is usually the case that the more basic a ligand is, the more stable is a complex containing such ligand. Thus most ligands used for this purpose are either a base, like an ethylendiamine or negative ions derived from a weak acid like oxalic acid.

In term of "acid dissociation constant" to describe the stability of a complex, the basicity of a ligand may be expressed by the acid dissociation constant pK of a conjugate acid of such base ligand, and the complex having a ligand with a higher pK value is more stable.

Alkylamines usually have higher pK values, thus forming stable complexes. particularly, such complexes as have a polydentate group such as an ethylendiamine are much more stable than those complexes having mono-detate like ammonia and undergo ligand exchange reaction at slower rate.

Generally speaking, the most stable chelate ring is in a 5-membered ring, and in view of this fact, too, ethylene-diamine forms a 5-membered ring chelate and thus provide a stable complex.

The complexes used in the present invention, which can exist stably under alkaline condition without causing ligand exchange reaction, are such complexes having poly-dentate ligands like ethylenediamine derivatives, and in this type of complex, in the absence of a suitable reducing condition, the photographically useful group can stably be bound to the the central metal complex through the poly-dentate group even under alkaline condition.

In the complex used in the present invention, at least one electron can induce the release of a ligand and as the result of this, it becomes possible for a plurality of photographically useful groups which are pendantly attached to the ligand to be released efficiently even in the stoichio metrical point of view.

Accordingly, employment of such kind of metal complexes can provide the photographic element with various advantages such as reducing of silver used and the film thickness of the photographic element, which would lead to speeding up of processing time and improvement in sharpness of images to be formed.

In the present invention a metal complex selected from a group of metal complexes represented by the general formula [I] is preferably used:

$$[Me(La)_p(Lb)_qLc)_r]Y_t \quad [I]$$
$$\quad\quad\quad\quad | \quad\quad | \quad\quad\quad\quad$$
$$\quad\quad\quad\quad X_1 \quad X_2$$

wherein Me represents a transition metal, La and Lb independently represent a polydentate group, Lc represents a mono- or poly-dentate group, $X_1$ represents a photographically useful group, $X_2$ represents a photographically useful group or a ballast group, Y represents a counter ion, p, q and r respectively represent an integer indicating the number of ligands and t represents a number as determined by the complex salt neutralization rule, provided that p is an integer of 1 to 3, q is an integer of 0 to 3 with the proviso that when q is 0, p is 2 or 3, r is an integer of 0 to 8 with the proviso that when r is 2 or more Lc may be either the same or different, and t is a number of 0 to 6.

According to Taube's classification, preferable metal complexes are selected from those having a coordination number of 6, and the central metal which is suitable for the complex of the invention is selected from those transition metals having no inner d-orbital when a complex is formed, for example, from $Cr^{(III)}$, $Co^{(III)}$ and $Rh^{(III)}$.

Among those metals mentioned above, the most preferable one is $Co^{(III)}$.

As the poly-dentate group suitably used in the present invention, or according to the preferable embodiment of the invention poly-dentate group represented as La, Lb or Lc, for example, a (N—N) type ligand such as an ethylenediamine derivative (e.g., an ethylenediamine, propylenediamine and tri-methylenediamine), a (O—O) type ligand such as a -diketone derivative, dicarboxylic acid derivative and salicylic acid derivative (e.g., acetylacetone, malonic acid, salicylic acid, a (N—O) type lignd such as enaminoketone and a (S—S) type ligand such as ethanedithiol, most of the above ligands are of didentate. Further a tridentate ligand such as diethylenetriamine, ethylenediaminemonoacetic acid or iminodiacetic acid, and a tetradentate such as triethylenetetramine may also be used in the present invention.

According to more preferable embodiment of the present invention, in the general formula [I], Me is $Co^{(III)}$, La is selected from a mono-valent radical derived from an ethylendiamine derivative, a B-diketone derivative, a dicarboxylic acid derivative or a salicylic acid derivative, Lb is a mono-valent radical derived from an ethylenediamine derivative.

Lc is a ligand to fill up the vacant coordination site of the metal complex and may be either a poly-dentate group or a mono-dentate group such as water or ammonia. In a preferable embodiment of the present invention, Lc is an ethylenediamine derivative.

In the present invention, preferable ethylenediamine derivative is represented by the general formula [II]:

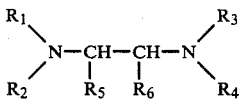

(II)

wherein $R_1$, $R_2$, $R_3$, $R_4$, $R_5$ and $R_6$ independently represents a simple bond, a hydrogen atom, an alkyl group, preferably one having 1 to 7 carbon atoms, or an aryl group, preferably one having 6 to 7 carbon atoms, which alkyl group and aryl group may be substituted provided that when said derivative is a mono-valent radical one of $R_1$, $R_2$, $R_3$, $R_4$, $R_5$ and $R_6$ is a simple bond or a di-valent radical. The most referable atom or group for $R_1$, $R_2$, $R_3$, $R_4$, $R_5$ and $R_6$ is hydrogen atom, methyl group and ethyl group.

As for the ethylenediamine derivative, ethylenediamine, 1,2-diaminopropane, N-methyl-ethylenediamine, N-ethylethylenediamine, N,N-dimethylethylenediamine, N,N-diethylethylenediamine, etc., can be mentioned.

In the present invention, preferable mono-valent -diketone derivative is represented by the following formula (III);

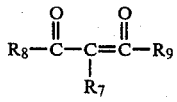

(III)

wherein $R_7$ represents a simple bond, hydrogen atom, an alkyl group, preferably one having 1 to 7 carbon atoms which may be substituted (such as a methyl group, an ethyl group or a benzyl group), an aryl group, preferably one having 6 to 7 carbon atoms which may be substituted (such as a phenyl group or a tolyl group) $R_8$ and $R_9$ independently represent a simple bond, an alkyl group, preferably one having 1 to 7 carbon atoms which may be substituted (such as a methyl group, an ethyl group or a tri-fluoromethyl group), or an aryl group, preferably one having 6 to 7 carbon atoms which may be substituted (such as a phenyl group), provided that one of $R_7$, $R_8$ and $R_9$ is a simple bond or a di-valent radical.

Further in the present invention, preferable mono-valent dicarboxylic acid derivative is represented by the following formula (IV);

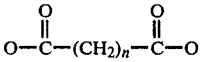

(IV)

wherein, n is an integer of 1 to 2 provided that one of the hydrogen atoms is to be substituted by the photographically useful group.

As the most preferable examples of mono-valent -diketone derivatives and dicarboxylic acid derivatives, a derivative of a benzoylacetone, an acetyl acetone or a malonic acid can be mentioned.

Further in the present invention, preferable mono-valent salicylic acid derivatives are represented by the following formula (V);

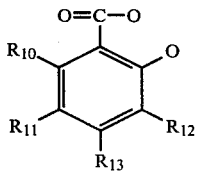

(V)

wherein, $R_{10}$, $R_{11}$, $R_{12}$ and $R_{13}$ independently represent a simple bond, a hydrogen atom, a halogen atom, a sulfo group, a cyano group, a carboxyl group, a nitro group or an alkyl group, preferably one having 1 to 7 carbon atoms which may be substituted provided that one of $R_{10}$, $R_{11}$, $R_{12}$ and $R_{13}$ is a simple bond or a di-valent radical and when one or more of $R_{10}$, $R_{11}$, $R_{12}$ and $R_{13}$ are an alkyl group, any one of $R_{10}$ and $R_{11}$, $R_{11}$ and $R_{12}$ and $R_{12}$ and $R_{13}$ may be cooperatively linked to form either a saturated 6-membered ring (such as a tetrahydronaphthalene ring) or an unsaturated 6-membered ring (such as a naphthalene ring) and that at least one of $R_{10}$, $R_{11}$, $R_{12}$ and $R_{13}$ is a simple bond or a di-valent radical.

As a salicylic acid derivative more preferable one is the compound in which $R_8$ is a simple bond, and in the most prefeable compound, $R_9$ is a simple bond to which PUG is to be attached.

In the general formula [I], Y represents a counter ion, which may be either an anion or a cation and the number of electric charge thereof is determined by electric charge neutralization rule. Preferable anion includes an alkaline metal ion and a quaternary ammonium ion and preferable cathion includes a halide ion, a sulfite ion, a sulfate ion, an alkylsulfonate or arylsulfonate ion, a nitrate ion, a nitrite ion, a perchlorate ion such as a halocarboxylate ion, an acetate ion, a hexanoate ion, a hexa fluorophosphate ion, a tetrafluoroborate ion and the like.

In the present invention the photographically useful group means any optional group which is capable of rendering a photographically useful effect and, more specifically, this PUG is either one or more (when the complex has a plurality of PUG's) groups selected from a dye, a development inhibitor, an anti-foggant, a development accelerator, a silver halide solvent, a developing agent, a toning agent, a fixing agent, or a hardening agent, or a precursor thereof, etc.

According to the most preferable embodiment of the present invention said photographically useful group is a dye and/or a development inhibitor, or a precursor thereof.

Further in the present invention, the ballast group means an organic group having enough molecular disposition or weight to make the metal complex immobile in the photographic element. According to the preferable embodiment of the present invention said ballast group is selected from an organic group, preferably from an alkyl group containing 8 to 30 carbon atoms which may be substituted, and more preferably, said ballast group is an alkyl group containing 14 to 30 carbon atoms. Representative example of the ballast group includes a N-substituted carbamoyl group such as N-alkylcarbamoyl group, an alkylthioether group, a N-substituted sulfamoyl group such as a N-alkylsulfamoyl group and an alkoxycarbonyl group.

In the present invention, the metal complex can contain either single or a plural number of PUG's and ballast groups respectively, and when the complex contains a plurality of PUG's and/or ballast groups they may consist of either the same kind or the different kinds respectively.

In case a complex is provided with two or more ballast groups, for example, two small groups, for example, one containing 5 to 12 carbon atoms, may be used to give the complex the same immobility.

Further, in the above general formula [I], p, q and r respectively represent an integer indicating the number of ligand and t represents a number as determined by the complex salt neutralization rule, provided that p is an integer of 1 to 3, q is an integer of 0 to 3 with the proviso that when q is 0, p is 2 or 3, r is an integer of 0 to 8 with the proviso that when r is 2 or more Lc may be either same or different, and t is an number of 0 to 6.

In a preferable embodiment of the present invention p is 1, q is 1 or 2, r is 0 or 1 with the proviso that $q+r=2$.

The above general formula [I] relates only to a mononuclear metal type of complexes, however, the present invention is not intended to cover only such type of metal complexes but also to cover ultinuclear complexes, by which it may be possible to increase the content of the photographically useful group in the metal complex and to attain more nondiffusibility.

In case the photographically useful group is a development inhibitor or antifogging agent or precursor of either of them, such photographic agent is selectively released in undeveloped areas to restrain development of fogging there to give a favorable image. As examples of the useful development inhibitors, 5-mercaptotetrazoles and benzotriazoles can be mentioned. Azaindenes can be mentioned as representative examples of the antifogging agent.

In the present invention when the photographically useful group is either a dye or its precursor, the complex is particularly advantageous as a dye image forming group for color diffusion transfer process.

When a diffusible dye or its precursor is used as PUG in the metal complex, it can selectively release a dye in the undeveloped area, so that a positive dye image may be obtained in the image-receiving layer by using a negative type light-sensitive silver halide emulsion.

Further, using an internal latent image type direct positive emulsion in combination with the normal print system from a negative, a positive dye image can also be obtained in the image receiving layer. Further, using a positive emulsion and performing delamination, bleach, and fixing after developing process, a positive residual image can be obtained.

As a dye to be used as PUG, any dye moiety that is known in the field of color diffusion transfer photography may be used and as representative examples azo dyes, azomethine dyes, anthraquinone dyes and phthalocyanine dyes can be mentioned.

In the case the complex is used as a dye image forming group, the complex should preferably be incorporated in such a layer so that it may not reduce the sensitivity of the light-sensitive silver halide emulsion used in combination therewith.

Namely, when the absorption band of the dye contained overlaps the spectrally sensitive region of a light-sensitive silver halide emulsion layer used in combination therewith, the complex should preferably be incorporated in a layer behind such light-sensitive silver halide layer with respect to the direction of exposure.

By contrast, in the case the complex contains a dye precursor which forms a dye only after exposure, the complex may be incorporated in the light-sensitive silver halide emulsion layer itself or in either layer adjacent thereto, front or behind, because it would never reduce the sensitivity of the silver halide emulsion. Examples of such dye precursor group are a leuco form of dyes that becomes colored by oxidation, or a so-called shift type dye that changes its color by pH change, hydrolysis, formation complex of a with a metal ion, or the like.

The complexes of the present invention are generally added to the coating composition at an amount of $1\times10^{-5}$ to $5\times10^{-3}$ mol/m$^2$ and preferably to $1\times10^{-4}$ to $2\times10^{-3}$ mol/m$^2$ with respect to the final product and they are dispersed by various dispersion techniques hitherto known. Representative examples of such dispersion techniques are mentioned below.

(1) Technique wherein a complex of the invention is dissolved into a practically water-insoluble solvent of high boiling point and finely dispersed into hydrophilic protective colloid.

Examples of a particularly useful solvent of high boiling point are N-n-butylacetanilide, diethyllauroylamide, dibutyllauroylamide, dibutyl phthalate, tricresyl phosphate, and N-dodecylpyrrolidone.

To facilitate the dissolution of the complex in the above technique, a solvent of low boiling point or water-soluble organic solvent may be used.

Examples of such solvent of low boiling point are methyl acetate, ethyl acetate, cyclohexanone, acetone, methanol, ethanol, and tetrahydrofuran, while examples of such water-soluble organic solvent are 2-methoxyethanol and dimethylformamide. Solvents of low boiling point or water-soluble organic solvents as cited above can be removed by drying after coating or rinsing with water.

(2) Technique wherein a complex of this invention is dissolved into water-miscible organic solvent and a volume of water that is enough to make the complex insoluble in the above solution is then added gradually to load particles of polymer latex.

The water-miscible organic solvent and the loadable kind of polymer latex as mentioned above are described in details in Japanese Patent O.P.I. Publication Nos. 59942/1976 and 59943/1976.

(3) Technique wherein the compound of a complex is ground finely by a mechanical means such as a sand grinder or colloid mill to disperse into hydrophilic colloid.

(4) Technique wherein after a complex is dissolved into a water-miscible organic solvent, it is precipitated in water jpreferably under presence of a surfactant and the precipitates are dispersed into hydrophilic colloid, as disclosed by Japanese patent application No. 54108/1977.

(5) Technique wherein after a complex is dissolved together with a polymer compound into alkaline solution, an acid is added to the resultant solution for its PH adjustment to precipitate the complex for dispersion into hydrophilic colloid.

The light-sensitive silver halide emulsion as related to the invention comprises a colloidal emulsion, for example, of silver chloride, bromide, bromochloride, iodobromide, or chloride iodobromide, or their mixture. The silver halide compound used for such silver halide emulsion may be fine- or coarse-grained, being useful if its average grain size is in a range from about 0.1$\mu$ to about 2$\mu$.

Further, the above silver halide emulsion may be prepared by any of the known methods.

A type of silver halide emulsion that is loaded with silver halide grains whose sensitivity practically lies in their surface may be used or another type of silver halide emulsion that is loaded with silver halide grains whose sensitivity practically lies in their core may also be used.

In the present invention, the emulsion may be of negative or direct positive type.

For the multicolor dye image reproduction, two or more sensitive silver halide emulsion layer, each combined with a complex containing a dye or dye precursor, are preferably used, with interlayers preferably provided between these combination units. The interlayers serve to not only suppress possible unpreferable interactions between combination units but control the diffusion of the diffusible dyes or their precursors or alkali processing composition.

For the base of the photographic element as related to the invention, any hitherto known base of photographic material may be used, which may be transparent or opaque depending on the purpose.

A photographic element that is loaded with photographically useful substance groups of the complex as mentioned above as a dye image forming groups is particularly useful as a photographic element for the color diffusion transfer process. Such photographic element may be provided in various forms, a representative form comprising a first support, a silver halide emulsion layer adjacent thereto and combined with a complex containing a dye image forming group, a image receiving layer and a second support in this order as necessary elements.

Ordinarily, the alkali processing composition is inserted at the time of processing between the first base and silver halide emulsion layer or between the image receiving layer and silver halide emulsion layer.

Such base coating as to provide a neutralization layer and timing layer between the first support and silver halide emulsion layer or between the second support and image receiving layer is preferable. Beside, various layers normally used in the photographic element for the color diffusion transfer process, such as the light reflection layer, opaque layer and protective layer, may be used and various additives may be added.

Particularly, a type of photographic element for the color diffusion transfer process that is preferable for use in the reproduction of multicolor dye image comprises between a pair of bases a image receiving layer, light reflection layer, opaque layer, red sensitive silver halide emulsion layer combined with a cyan dye image forming compound, interlayer, green sensitive silver halide emulsion layer combined with a magenta dye image forming compound, interlayer, blue sensitive silver halide emulsion layer combined with a yellow dye image forming compound, protective layer, timing layer and neutralizing layer in this order as necessary layers.

Examples of the above complexes as related to the invention are given below, though these examples are intended to illustrate the invention and are not to be construed to limit the scope of the invention.

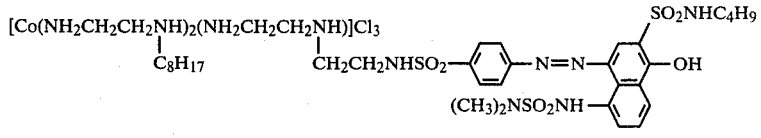

(1)

-continued
(2)
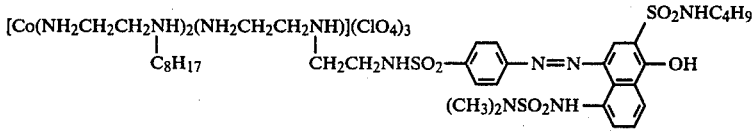
(3)
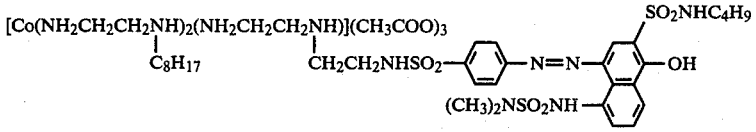
(4)
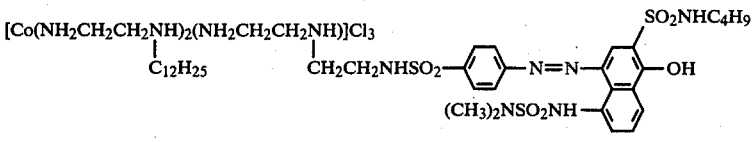
(5)
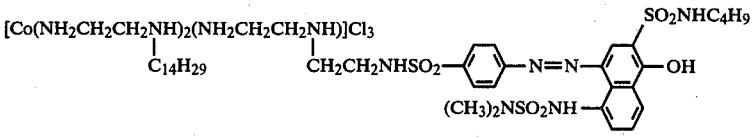
(6)
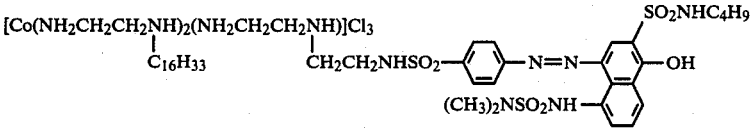
(7)
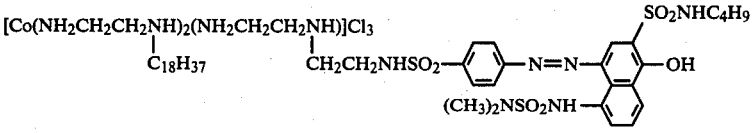
(8)
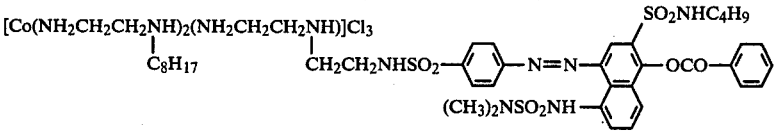
(9)
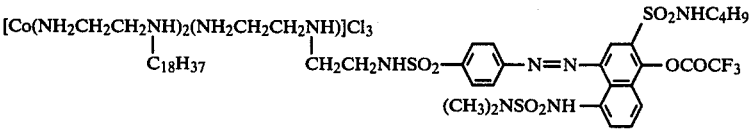
(10)
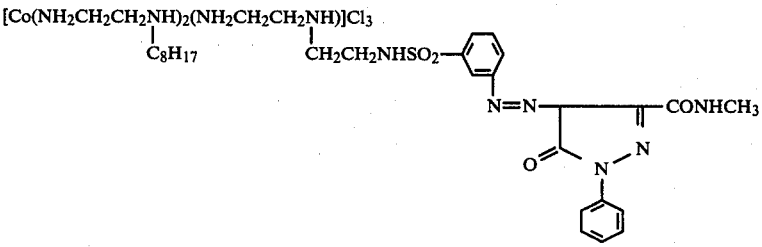
(11)
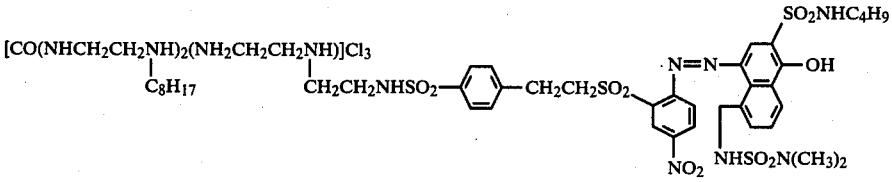

-continued
(12)
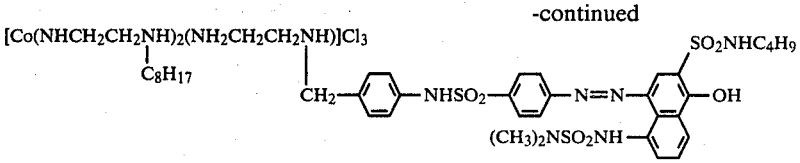
(13)
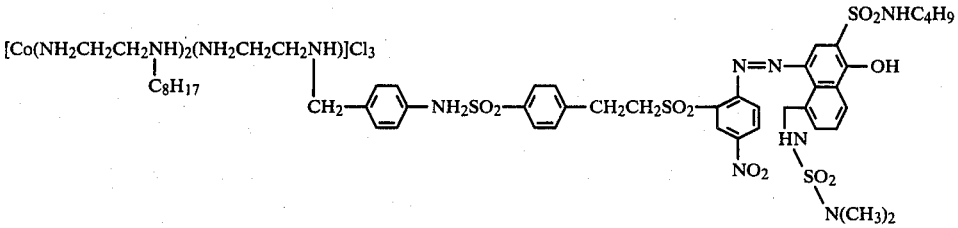
(14)
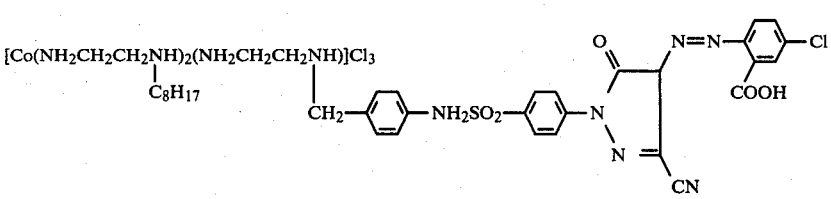
(15)
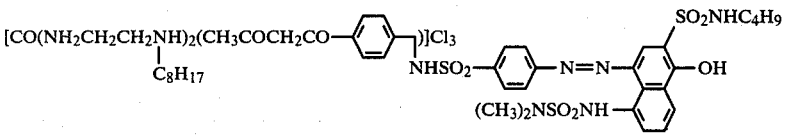
(16)
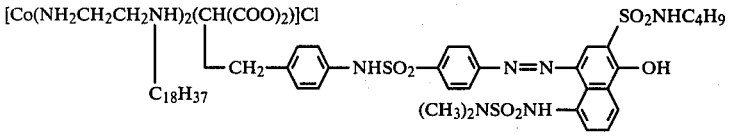
(17)
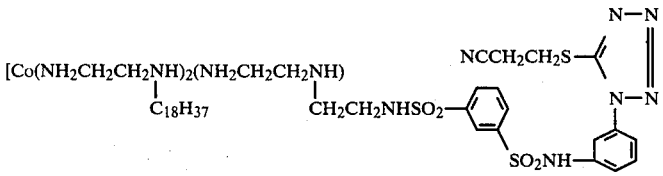
(18)
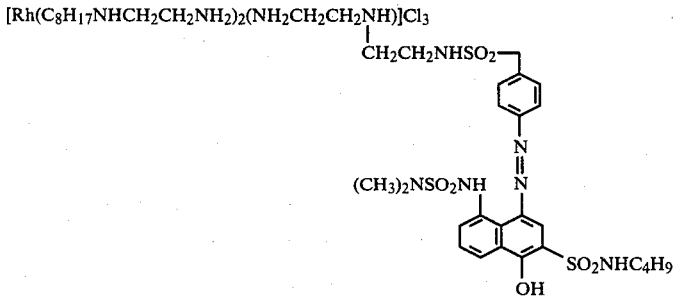
(19)
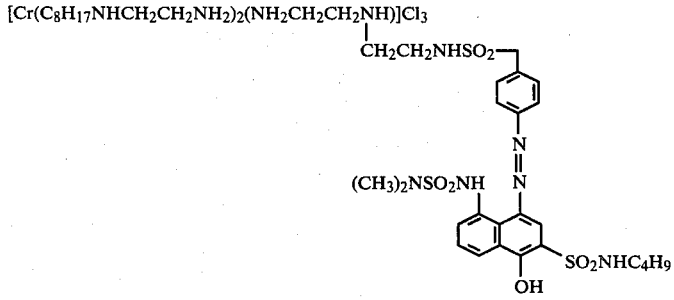

-continued
(20)
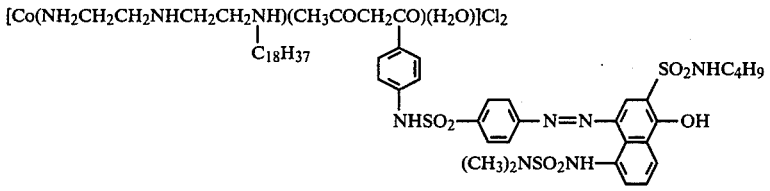
(21)
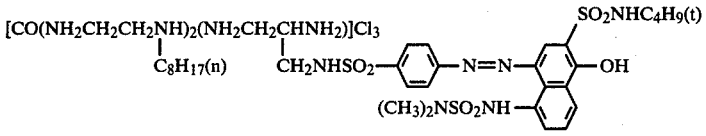
(22)
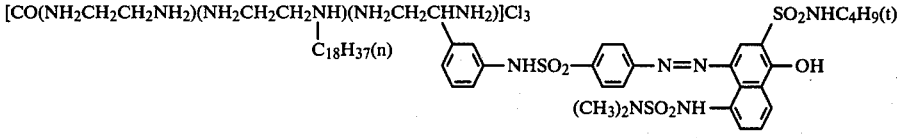
(23)
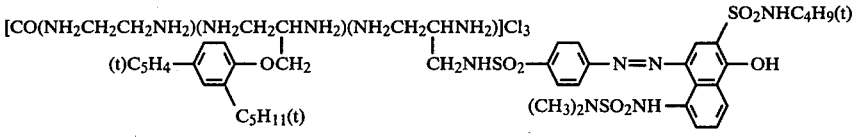
(24)
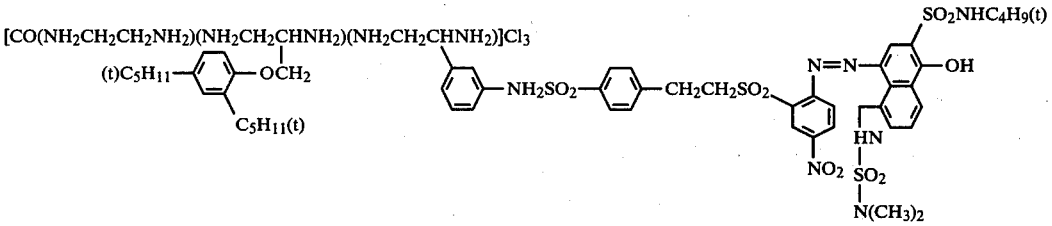
(25)
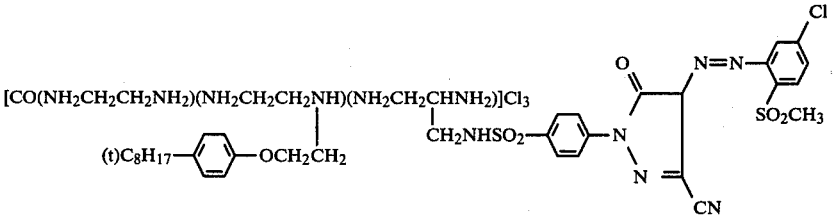
(26)
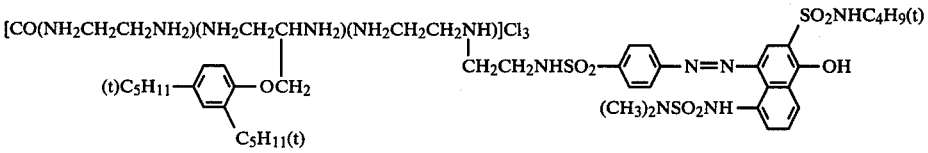
(27)
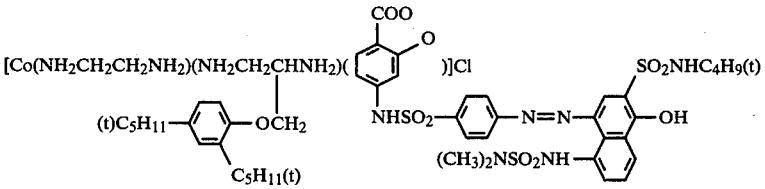
(28)
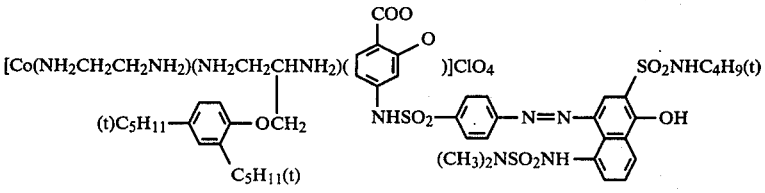

-continued
(29)
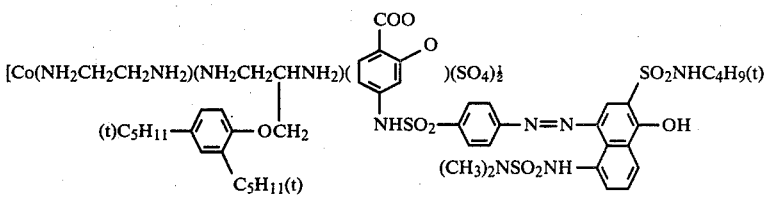
(30)
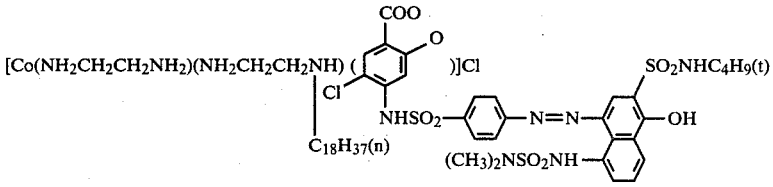
(31)
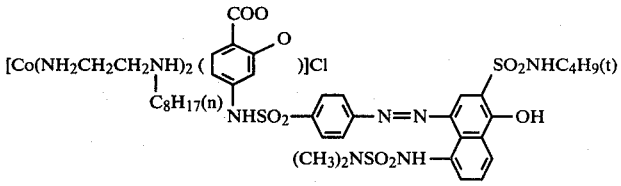
(32)
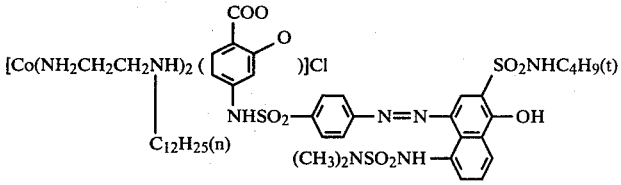
(33)
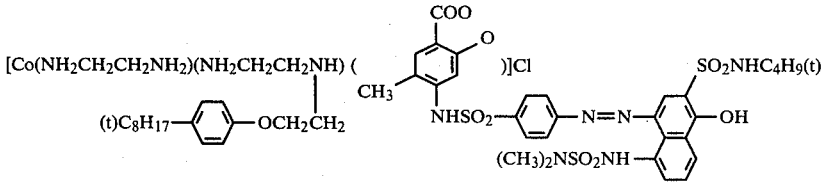
(34)
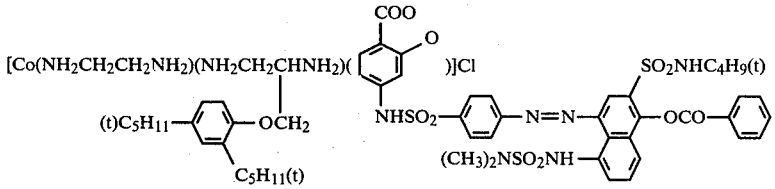
(35)
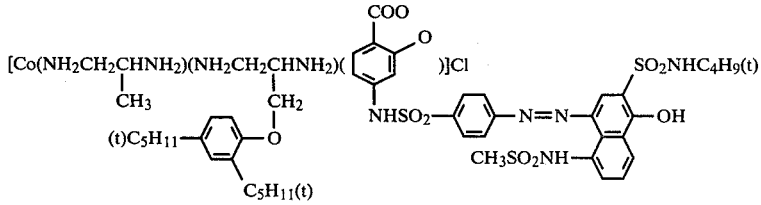
(36)
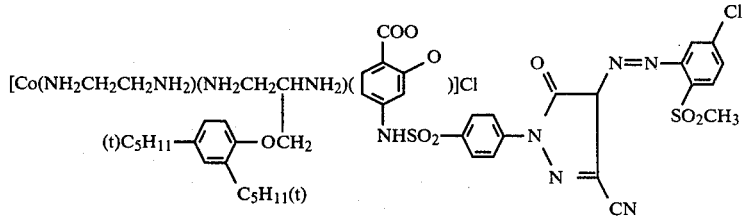

-continued
(37)
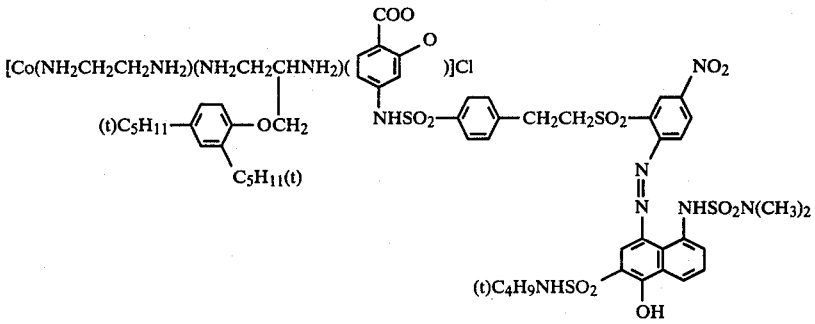
(38)
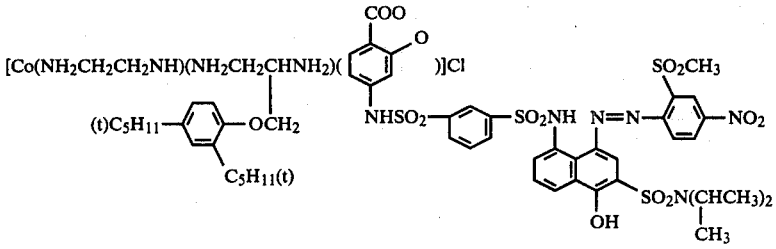
(39)
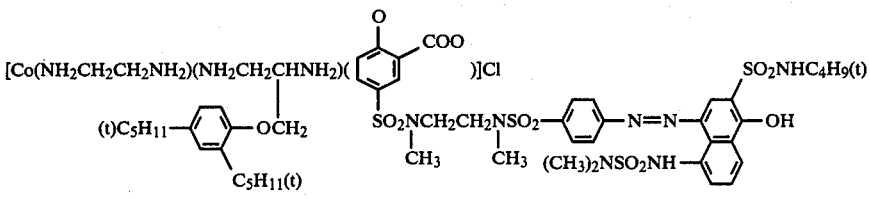
(40)
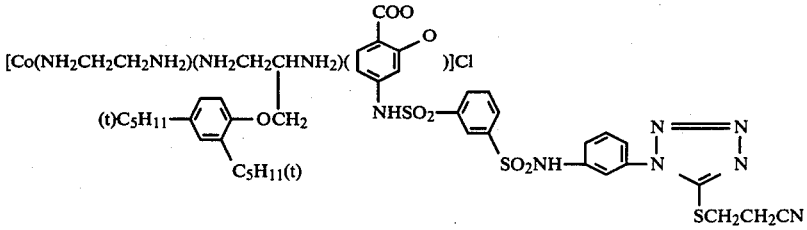
(41)
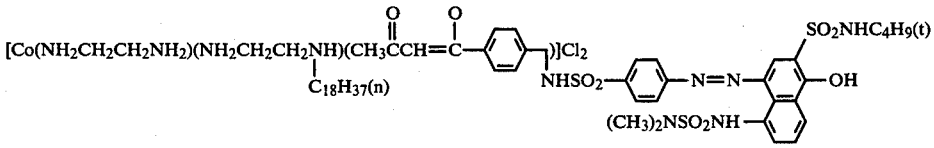
(42)
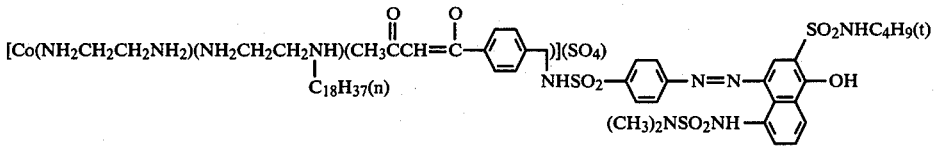
(43)
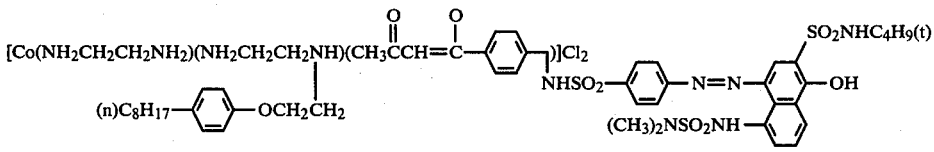
(44)
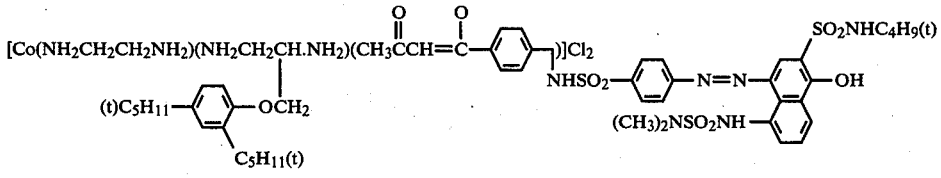

-continued
(45)
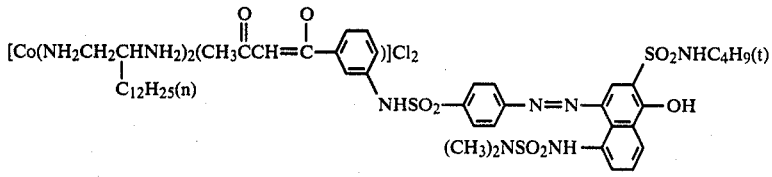
(46)
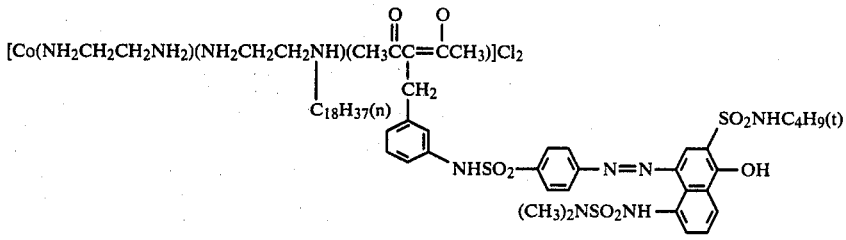
(47)
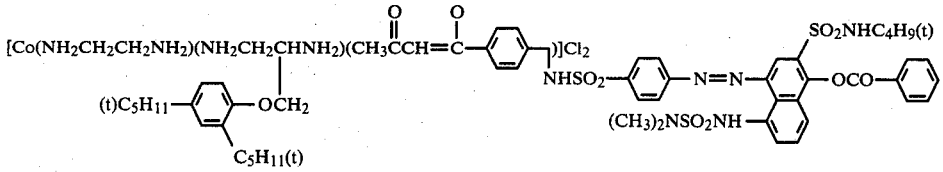
(48)
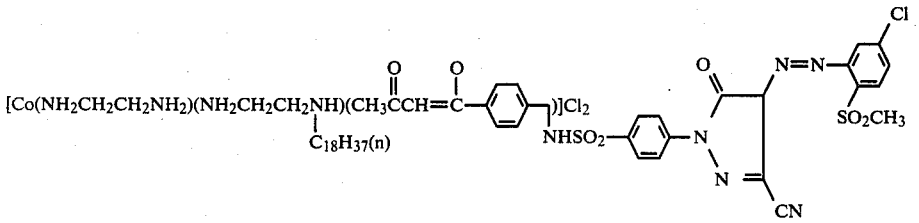
(49)
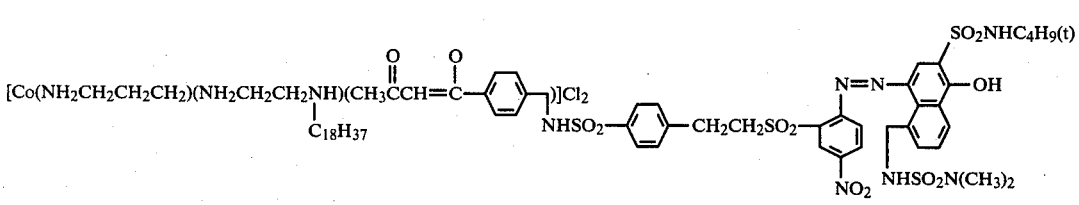
(50)
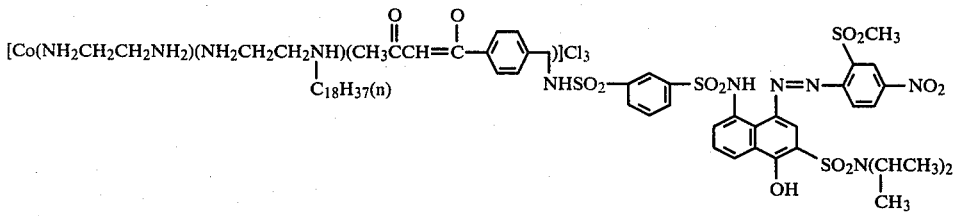
(51)
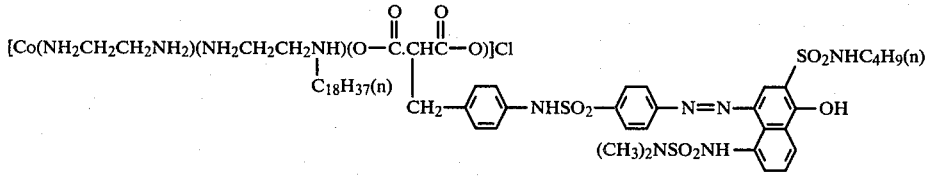
(52)
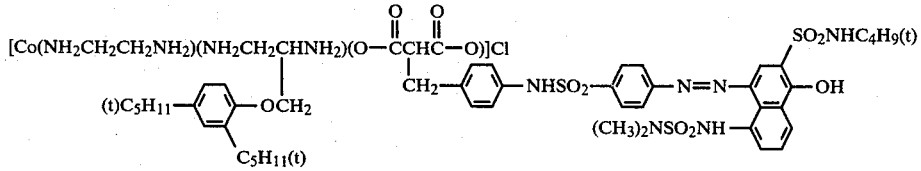

-continued

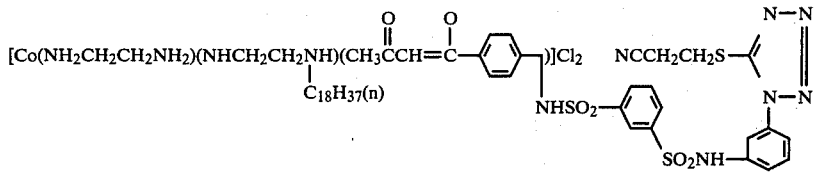

(53)

The above mentioned complexes as related to the present invention were synthesized by the following method:

(1) An intermediate complex was synthesized by reacting a ligand having a ballast group with a central transition metal ion.

(2) Next, the intermediate complex was reacted with a tridentate ligand such as diethylenetriamine to synthesize a complex having groups (amines, OH, COOH, etc.), each capable of binding photographically useful group such as a dye.

(3) A CLER compound was synthesized by reacting the above complex with a dye moiety such as a dye sulfonyl chloride.

In the synthesis of compounds for the above illustrated concrete examples of complexes (CLER compounds) as related to the present invention, each of the synthesized compounds was identified with its molecular structure by electron spectrometry and infrared spectrophotometry, and in some cases further by NMR spectrometry. When applicable, a method was used to measure the melting point of the intermediate to further confirm the product.

Next, the methods of synthesis are concretely described by listing synthetic techniques.

EXAMPLE OF SYNTHESIS 1

(i) Synthesis of N-octylethylenediamine 50 g (0.83 mol) of anhydrous ethylenediamine, 31.2 g (0.21 mol) of octyl chloride and 400 ml of ethanol were mixed and refluxed 6 hours under heating. After evaporation of ethanol under reduced pressure, the lower layer was removed and 200 ml of benzene and 100 ml of water were added to the upper layer for full rinsing. The benzene fraction was dried over anhydrous sodium sulfate, concentrated and then cooled to precipitate crystals. After filtering, crystals were redissolved into 200 ml of benzene and the solution was fully rinsed with water. After being dried over anhydrous sodium sulfate, the benzene solution was concentrated and cooled to precipitate crystals. After filtration, crystals were washed with a small volume of methanol.

Yield: 81% (29.2 g), M.P.: 29° to 31° C.

(ii) Synthesis of dichlorobis(N-octylethylenediamine)-cobalt(III) chloride 36.2 g (0.21 ml) of N-octylethylenediamine was dissolved into 1.3 l of methanol by heating. 33.9 g (0.14 mol) of cobalt chloride hexahydrate and 100 ml of methanol were added to the resultant solution under agitation. With the temperature of the bath kept at 40.0° C., the solution was bubbled 14 hours with air for reaction. 77 ml of conc. hydrochloric acid was added and then the solution ws bubbled another 15 hours with air for further reaction. Concentration followed by cooling resulted in precipitation of green crystals, which were separated by filtration and washed with methanol.

Yield: 93% (49.8 g).

(iii) Synthesis of bis(N-octylethylenediamine)-diethylenetriamine-cobalt(III) chloride 67.8 g of dichlorobis(N-octylethylenediamine)-cobalt(III) complex was dispersed into 800 ml of ethanol under heating. As soon as 15.1 g (0.146 ml) of diethylenetriamine dissolved into 100 ml of ethanol was added dropwise, the solution changed its color from green to yellowish brown. The solution was then further heated 3 hours at 60° C. for reaction. After reaction, the solution was concentrated and precipitates that appeared were separated by filtration and washed with a small volume of cold methanol.

Yield: 75% (61.1%).

EXAMPLE OF SYNTHESIS 2

Synthesis of illustrated compound (1)

10 g (0.016 mol) of bis(N-octylethylenediamine)-diethylenetriamine-cobalt(III) chloride was dispersed into 1 lit. of ethyl acetate under heating. The solution was then agitated 1 hour. 3.2 g of triethylamine and then 9.9 g (0.016 mol) of 4-[4-hydroxy-8-dimethylaminosulfonamido-3-(N-t-butylsulfamoyl)-1-naphthylazo]benzenesulfonyl chloride were added. The solution was refluxed 12 hours for reaction under heating. After cooling, precipitates that has formed were removed by filtration and washed with ethyl acetate, water, 0.1 N alkali solution, and water.

Yield: 76% (14.6 g).

EXAMPLE OF SYNTHESIS 3

Synthesis of illustrated compound (8)

10 g (0.016 mol) of bis(N-octylethylenediamine)-diethylenetriamine-cobalt(III) chloride was dispersed into 1 lit. of ethyl acetate by heating. The solution was agitated 1 hour. 3.2 g of triethylamine and then 11.4 g (0.016 mol) of 4-[4-benzoyloxy-8-dimethylaminosulfonamido-3-(N-t-butylsulfamoyl)-1-naphthylazo]benzenesulfonyl chloride were added. The solution was refluxed 12 hours for reaction under heating. After cooling, precipitates that had formed were removed by filtration and washed with ethyl acetate and then with water.

Yield: 72% (15.1 g).

EXAMPLE OF SYNTHESIS 4

Synthesis of illustrated compound (10)

10 g (0.016 mol) of bis(N-octylethylenediamine)-diethylenetriamine-cobalt(III) chloride was dispersed into 1 lit. of ethyl acetate under heating. The solution was agitated 1 hour. 3.2 g of triethylamine and then 6.7 g (0.016 mol) of 4-(3-chlorosulfonylphenylazo)-3-methylamino-carbamido-1-phenyl-5-pyrazolone were added. The solution was refluxed 8 hours for reaction under heating. After cooling, precipitates that had formed were removed by filtration and washed with ethyl acetate, water, 0.1 N alkali solution and water.

Yield: 78% (12.4 g).

EXAMPLE OF SYNTHESIS 5

Synthesis of illustrated compound (11)

10 g (0.016 mol) of bis(N-octylethylenediamine)-diethylenetriamine-cobalt$^{(III)}$ chloride was dispersed into 1 lit. of ethyl acetate under heating. The solution was agitated 1 hour. 3.2 g of triethylamine and then 12.1 g (0.016 mol) of 4-[2-2-(4-chlorosulfonylphenyl)ethylsulfonyl-4-nitrophenylazo]-5-(N,N-dimethylaminosulfonamido)-1-naphthol were added. The solution was refluxed 12 hours for reaction under heating. After cooling, precipitates that had formed were removed by filtration and washed with ethyl acetate, water, 0.1 N alkali solution, and water.

Yield: 68% (14.8 g).

EXAMPLE OF SYNTHESIS 6

Synthesis of a ligand having a ballast (1) Synthesis of 2,4-di-tert-amylphenylallylether 117.2 g of 2,4-di-t-amylphenol and 90.7 g of allylbromide was dissolved in 500 ml of acetone. Thereto was added 103.5 g of pottassium carbonate and refluxed in a water bath for 20 hours. Then reaction mixture was filtered under suction and filtration residue was rinsed with 100 ml of acetone, thereafter this was again mixed with the mother solution and then under reduced pressure acetone and excess allyl bromide was distilled out.

Yield: 137.6 g (2) Synthesis of 3-(2,4-di-tert-amylphenoxy)-1,2-dibromo propane 117.2 g of 2,4-di-tert-amylphenylallylether was dissolved in dry ether. This solution was cooled to 0° C. and under agitation, 80.0 g of bromine was added dropwise to the solution taking one hour. The resulting mixture was added into a separating funnel and rinsed twice with 500 ml of water to separate oil phase, dried with magnesium sulfate anhydride and, then, ether was distilled out under reduced pressure to obtain 210 g of pale yellow solution. The resultant solution was then distilled under diminished pressure.

Yield: 141 g (65%) (b.p. 160°-170° C./1 mmHg)

(3) Synthesis of 3-(2,4-di-tert-amylphenoxy)-1,2-diaminopropane

Into a 1-liter autoclave was added by 13.0 g of 3-(2,4-di-tert-amylphenoxy)-1,2-dibromo propane. Thereto was added a solution prepared by absorbing 67 g of ammonia by 400 ml of ethyl alcohol at −5° C. to −10° C., and then, and after sealing, the mixtute was heated and stirred for 20 hours at 130°-150° C. Thereafter, ethanol was distilled out under reduced pressure and the residue was dissolved in 100 ml of chloroform, which was subject to column chromatography to obtain pale brown oily substance.

Yield: 4.0 g (40%)

EXAMPLE OF SYNTHESIS 7

Synthesis of the intermediate complex

Synthesis of Carbonatoethylenediamine-[3-(2,4-di-tert-amylphenoxy)-1,2-diaminopropane]cobalt salt 5.3 g of potassium dicarbonatoethylenediamine-cobalt(III)acid and 1.3 g of potassium chloride were dissolved in 10 ml of water and thereto were added 300 ml of methanol and 3.8 g of [3-(2,4-di-tert-amylphenoxy)-1,2-diaminoropane], which was subject to reflux under heating. The color of the solution then changed from bluish purple to reddish purple. After being filtered and concentrated, the solution was cooled to obtain crystals in pink color. After filtration thereof the crystal was washed with methanol and hot ether.

Yield: 2.5 g (40%)

EXAMPLE OF SYNTHESIS 8

Synthesis of salicylic acid having a dye moiety

Synthesis of compound [I]

7.0 g of 4-aminosalicylic acid and 50 ml of pyridine were added to 500 ml of chloroform. Then the mixture was further added to by 30.0 g of 4-[4-hydroxy-8-dimethylaminosulfonamide-3-(N-tert-butylsulfamoyl)-1-naphthylazo]benzenesulfonyl chloride and refluxed for 3 hours under heating. After chloroform being distilled out under reduced pressure the remainder was added to water and the pH of the solution was adjusted with hydrochloric acid at pH 4. After allowing the mixture to stand still for one whole day, the deposited crystals were filtered and rinsed with water.

Yield: 21.2 g (59%) (m.p. 175°-180° C.)

Compound [I]

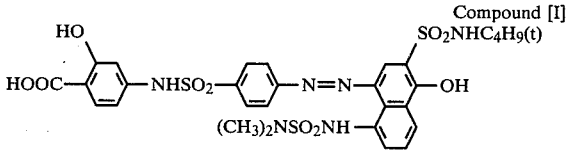

EXAMPLE OF SYNTHESIS 9

Synthesis of CLER Compound (27)

5.0 g of the intermediate complex obtained in Example of synthesis 7 was added to 500 ml of ethanol and dissolved under heat. And thereto, 20 ml of 1 N-hydrochloric acid was added and the mixture was refluxed for 30 minutes. Subsequently, 5.0 g of Compound [I] obtained by Example of synthesis 9 and 20 ml of 1 N-sodium hydroxide were added and the mixture was refluxed for 3 hours under heating. Then the solvent was concentrated and filtered and the solid part was washed with methanol, water, 0.1 N-aqueous alkaline solution and water in order.

Yield: 5.8 g (67%)

EXAMPLES OF SYNTHESIS 10

Synthesis of CLER Compound (36)

5.0 g of the intermediate complex obtained in Example of synthesis 7 was added to 500 ml of ethanol and dissolved under heat. And thereto, 20 ml of 1 N-hydrochloric acid was added and the mixture was refluxed for 30 minutes. Subsequently, 4.2 g of Compound [II] shown below and 20 ml of 1 N-sodium hydroxide were added for reflux for 3 hours under heating. Herein, Compound [II] was synthesized in the similar manner as in Compound [I]. After the reaction, the solvent was concentrated and filtered and the solid part was washed with methanol, water, 0.1 N-aqueous alkaline solution and water in order.

Yield: 5.8 g (67%)

Compound [II]

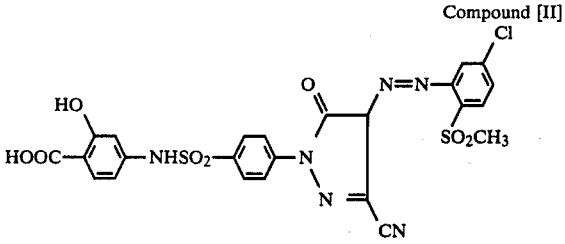

EXAMPLES OF SYNTHESIS 11

Synthesis of CLER Compound (37)

5.0 g of the intermediate complex obtained in Example of synthesis 7 was added to 500 ml of ethanol and dissolved under heat. And thereto, 20 ml of 1 N-hydrochloric acid was added and the mixture was refluxed for 30 minutes. Subsequently, 6.5 g of Compound [III] shown below and 20 ml of 1 N-sodium hydroxide were added for reflux for 3 hours under heating. Herein, Compound [III] was synthesized in the similar manner as in Compound [I]. After the reaction, the solvent was concentrated and filtered and the solid part was washed with methanol, water, 0.1 N-aqueous alkaline solution and water, and then subjected to column chromatography.

Yield: 4.2 g (43%)

EXAMPLE OF SYNTHESIS 13

Synthesis of the intermediate complex

Synthesis of Carbonatoethylenediamine-(N-n-octadecylethylenediamine)cobalt(III) chloride 10.0 g of potassium dicarbonatoethylenediamine-cobalt(III)acid was dissolved in 20 ml of water and thereto were added 1 liter of methanol and 10.0 g of N-n-octadecylethylenediamine and the mixture was refluxed under heating ethylenediamine and the mixture was refluxed under heating for one hour. Then the color of the solution then changed from bluish purple to reddish purple. After being filtered and concentrated, the solution poured into aqueous sodium salt solution. Separated deposit was filtered and rinsed with water, and thereafter washed with methanol and hot ether.

Yield: 11.3 g (67%)

EXAMPLE OF SYNTHESIS 14

Synthesis of benzoylacetone having a dye moiety

Synthesis of Compound [IV]

6.4 g of 1-p-aminophenylbutane-1,3-dione was dissolved in 1 liter of pyridine and heated. Then 24.2 g of 4-[4-hydroxy-8-dimethylaminosulfonamide-3-(N-tert-butyl-sulfamoyl)-1-naphthylazo]benzenesulfonyl chloride was added thereto little by little and after 5-minute reflux under heating the resultant mixture was allowed to stand still to cool down its temperature and then Compound [III]

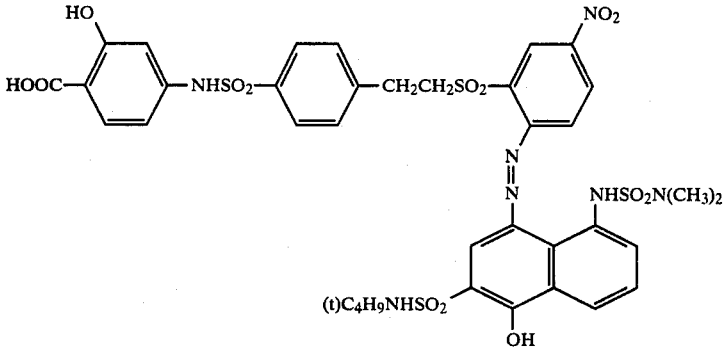

EXAMPLE OF SYNTHESIS 12

Synthesis of a ligand having a ballast (1) Synthesis of N,n-octadecylethylenediamine 137 g of ethylenediamine and 190 g of n-octadecyl bromide were was dissolved in 1 liter of ethanol and thereafter the mixture was refluxed under heating for 6 hours. After allowing the resultant mixture stand still overnight it was filterd and washed with ethanol and then dried.

Yield: 162 g (91%) (m.p. 78°-79° C.)

poured into diluted hydrochloric acid solution. The mixture was then extracted using ethyl acetate, rinsed with aqueous sodium bicarbonate until the solution became colorless without dye and then dried with sodium sulfate anhydride. After concentrating ethyl acetate solution, the mixture was poured into n-hexane and the separated crystals were filtered.

Yield: 15.6 g (58%) (m.p. 171°-175° C.)

Compound [IV]

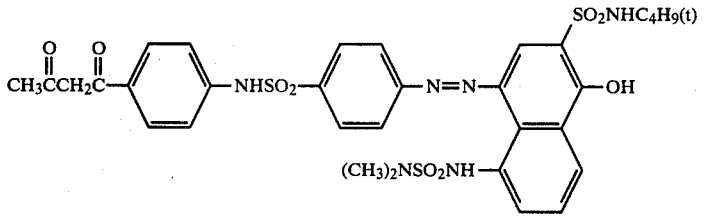

EXAMPLE OF SYNTHESIS 15

Synthesis of CLER Compound (41)

5.0 g of the intermediate complex obtained in Example of synthesis 13 was added to 1 liter of methanol and dissolved under heat. And thereto, 20 ml of 1 N-hydrochloric acid was added and the mixture was refluxed for 30 minutes. Subsequently, 5.2 g of Compound [IV] obtained by Example of synthesis 14 and 20 ml of 1 N-sodium hydroxide were added and the mixture was refluxed for 1 hour under heating. Then the solvent was concentrated and filtered and the solid part was washed with methanol, water, 0.1 N-aqueous alkaline solution and water in order, and then subjected to column choromatography.

Yield 6.2 g (52%)

EXAMPLES OF SYNTHESIS 16

Synthesis of CLER Compound (50)

Using the intermediate complex obtained in Example of synthesis 13 and Compound [V] shown below, CLER Compound was synthesized in the similar manner as in Example of synthesis 15.

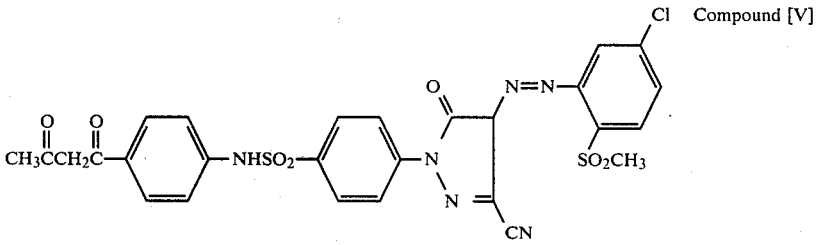

EXAMPLE OF SYNTHESIS 17

Synthesis of CLER Compound (51)

Using the intermediate complex obtained in Example of synthesis 13 and Compound [VI] shown below, CLER Compound was synthesized in the similar manner as in Example of synthesis 15.

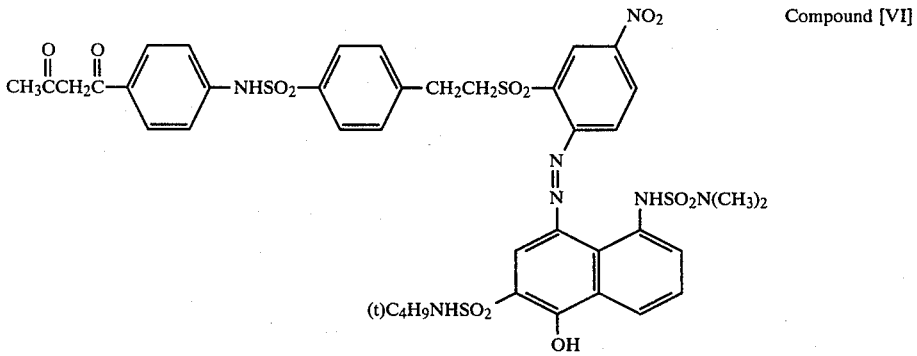

Complexes as related to the present invention are reduced by the electron donor. Various electron donors capable of reducing such complexes can be used regardless of whether they have a developing action on the silver halide.

The preferable electron donor has a rate of redox reaction with the complex as related to the invention that corresponds to 30 min or shorter in the half-value period under the processing condition of the photographic element.

In case a silver halide developing agent is used for the electron donor, the development of silver halide results in the oxidation of the developing agent, so the latter no more acts as the electron donor. The fraction of electron donor that remains in undeveloped areas reduces the complex present there to release the photographically useful group.

The preferable electron donor in the above case has a rate of redox reaction with the exposed silver halide as estimated in the half-value period which is 5 to 10 times faster than the rate of redox reaction with the complex of this invention.

Representative examples of the electron donor that also serves as the developing agent are ascorbic acid, hydroxylamines such as diethylhydroxylamine, and trihydroxypyrimidines such as 2-methyl-4,5,6-trihydroxy-pyrimidine. Electron donors that have no or just a weak developing action on the silver halide can also be used in a form of their precursor, when they are made available by hydrolysis of such precursors. Examples of such precursors are lactones, hydroquinones with at least one of their hydroxyl groups protected by a hydrolyzable group, and isoxazolones.

An electron donor whose developing action on the silver halide is weak for some reason or other is loaded, preferably in a form of its nondiffusible precursor, together with a complex as related to the present invention into a photographic element. The oxidized form of the silver halide developing agent that has resulted from the silver halide development then reacts with an electron donor produced by hydrolysis for the oxidation of the latter. The remaining electron donor reduces the complex to release the photographically useful group.

Preferable silver halide developing agents applicable in this case have a rate of redox reaction with the complex of the present invention as estimated in the half-value period which is 5 to 10 times slower than the rate of redox reaction between such complex and the electron donor.

Examples of the useful developing agent in the above are hydroquinone compounds including 2,5-dichlorohydro-quinone and 2-chlorohydroquinone, aminophenol compounds including 4-aminophenol, N-methylaminophenol, 3-methyl-4-aminophenol and 3,5-dibromaminophenol, catechol compounds including catechol, 4-cyclohexylcatechol, 3-methoxycatechol and 4-(N-octadecylamino)catechol, phenylenediamine compounds including N,N-diethyl-p-phenylenediamine, 3-methyl-N,N-diethyl-p-phenylenediamine, 3-methoxy-N-ethyl-N-ethoxy-p-phenylenediamine and N,N,N',N''-tetramethyl-p-phenylenediamine, and, particularly, 3-pyrazolidone compounds including 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidon, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazoldione, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-3-pyrazoldione, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methylpyrazolidone. The developing agents disclosed in U.S. Pat. No. 3,039,869 may also be used in combination. Such types of developing agent may be included into the formulation of the processing solution or at least partially incorporated into arbitarily selected one or more layers of the photographic element. For example, it may be incorporated into the silver halide emulsion layer, dye image forming compound layer, an interlayer, and/or an image-receiving layer.

In the present invention, the electron donor (or its preclursor) is preferably incorporated into the photographic element in a quantityhalf to 6 times as much as the complex as represented by the general formula [I] mentioned hereinbefore.

Among isoxazolone compound which are hydrolyzable electron donors, preferable ones are represented by the following formula [VI]:

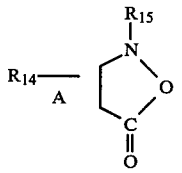

[VI]

where A represents a group of atoms necessary to form a 5- or 6-membered aromatic ring, and preferably a carbocyclic aromatic ring, $R_{14}$ represents a hydrogen atom or a group which contains 1 to 30 carbon atoms, and preferably, a ballast group that makes the compound nondiffusible in the photographic element, for example, a group containing 8 to 30 carbon atoms like a N-substituted carbamoyl group, e.g., a N-alkylcarbamoyl group, alkylthioether group, N-substituted sulfamoyl group such as N-alkylsulfamoylgroup, or alkoxycarbamoyl group, and $R_{15}$ represents a substituted or unsubstituted alkyl group containing 1 to 30 carbon atoms or a substituted or unsubstituted aryl group containing 6 to 30 carbon atoms, and preferably a methyl group.

Typical examples of the electron donor of the formula [VI] are shown herein below:

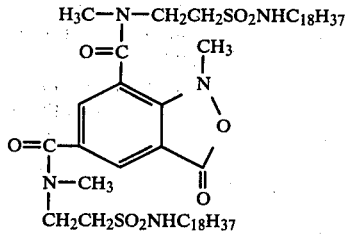

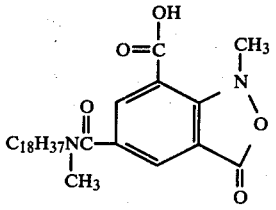

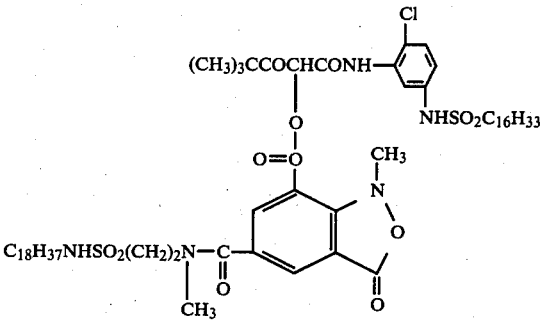

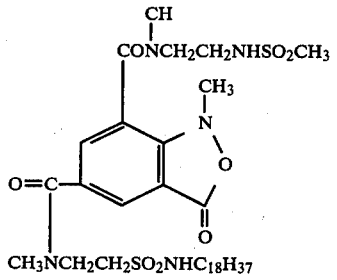

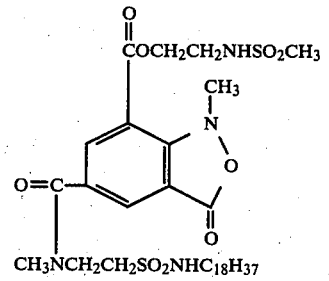

-continued
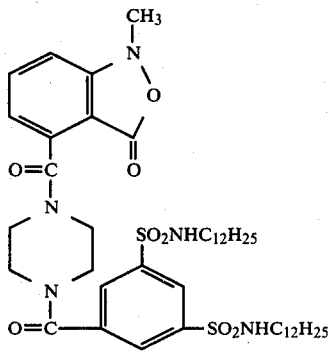
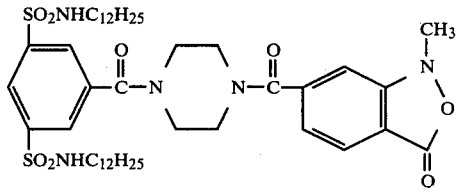
The following compounds are typical examples of lactones which are hydrolyzable electron donors.
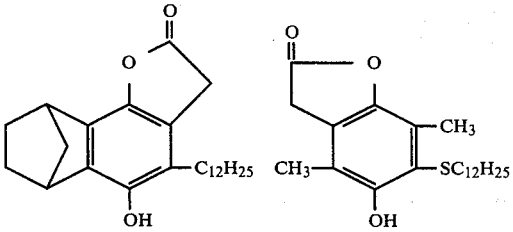
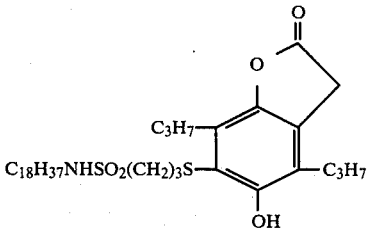
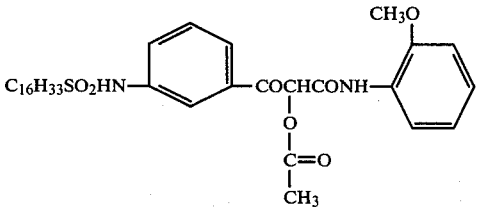
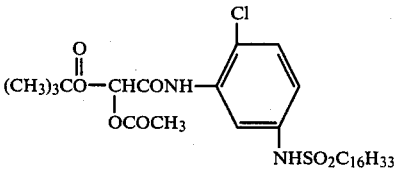
-continued
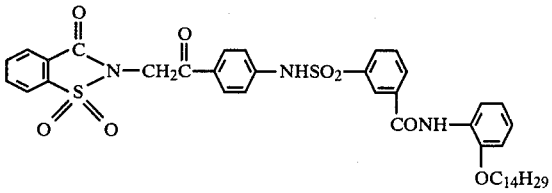
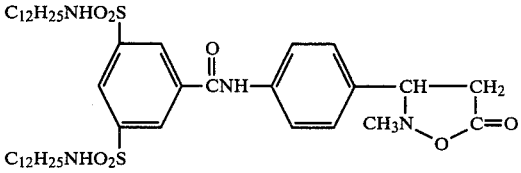
Further, following compounds can be mentioned as preferable compound employed in the present invention.
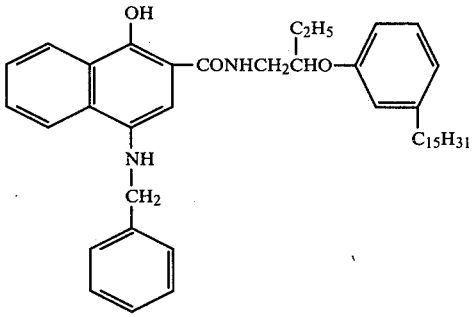
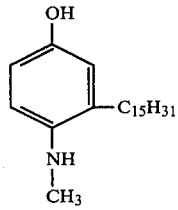
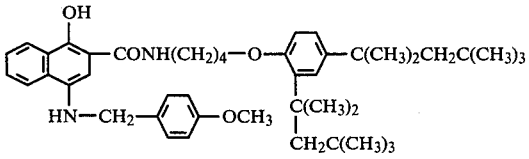
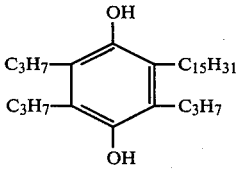
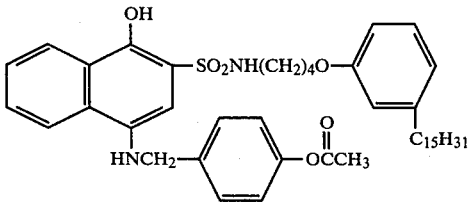

-continued

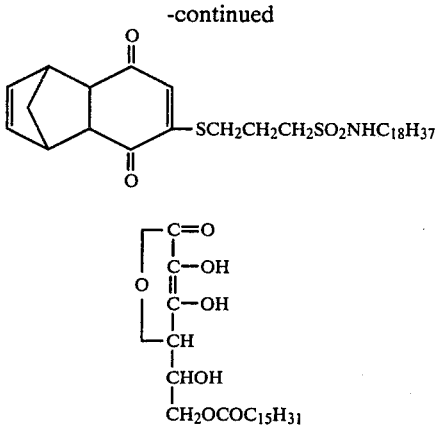

The present invention is further illustrated with reference to Examples, however, of course, the present is not limited to the following examples.

EXAMPLE 1

Preparation of a light-sensitive color photographic element comprising CLER Compound.

A photographic element was prepared by coating on a 150 μm thick transparent polyethylene terephthalate film support with the following layers:

(1) Image-receiving layer containing gelatin (2,7 g/m$^2$) and poly(styrene-co-N-benzyl-N,N-dimethyl-N-methacryloylaminophenylmethylammonium chloride-co-divinylbenzene) (molar ratio: 48:48:4) (2.7 g/m$^2$);

(2) Light reflection layer containing titanium dioxide (22 g/m$^2$) and gelatin (2.2 g/m$^2$);

(3) Opaque layer containing carbon black (2.8 g/m$^2$) and gelatin (1.8 g/m$^2$);

(4) Magenta dye image forming compound layer containing CLER compound (1)(0.44 g/m$^2$), benzisoxazolone as an electron donor (0.37 g/m$^2$), N,N-diethyllaurylamide (1.1 g/m$^2$), and gelatin (2.5 g/m$^2$);

(5) Green sensitive emulsion layer containing green sensitive silver iodobromide emulsion (0.76 g silver/m$^2$) and gelatin (1.15 g/m$^2$); and (6) Protective layer containing mucochloric acid (100 m g/m$^2$) and gelatin (1 g/m$^2$).

In the above, the dispersion of CLER Compound (1) was prepared as follows:

1 g of CLER Compound (1) was dissolved in 3 ml of N,N-dimethylformamide. In this solution 3 ml of ethyl acetate and N,N-diethyllaurylamide were added, and the resultant solution was dispersed into 25 ml of 10% gelatin aqueous solution containing 0.24 g of Alkanol XC (product of Du pont).

Next, a sheet of 100 μm thick transparent polyethylene terephthalate film base was coated with the following layers successively to provide a processing sheet:

(1) Neutralization layer containing poly(acrylic acid-co-butyl acrylate (75/25 in weight percentage)) (22 g/m$^2$);

(2) A timing layer containing a mixture of 95% by weight of cellulose diacetate (acetylation: 40%) and 5% of poly(styreneco-maleic anhydride) (5 g/m$^2$);

(3) A second timing layer containing poly(vinylidene chloride-co-acrylonitrile-co-acrylic acid) (79/15/6 in weight percentage) (1.1 g/m$^2$);

The photographic element thus prepared was subjected to predetermined amount of exposure through an optical wedge having 30 silver wedge steps with the density difference of 0.15 per step. The above processing sheet was then laminated to the exposed photographic element, with a rupturable pod containing 1.0 ml of a processing composition as formulated below therebetween to provide a film unit. The film unit thus prepared was passed between a pair of parallel pressuring rollers with a gap of about 340 um to rupture the pod, thereby to spread its contents between the photographic element and processing sheet.

The above processing solution was formulated as follows:

| | |
|---|---|
| Sodium hydroxide | 56 g |
| Sodium sulfite | 2.0 g |
| 4-hydroxymethyl-4-methyl-1-phenyl-3-pyrazolidone | 8.0 g |
| 5-methylbenzotriazole | 2.8 g |
| Carbon black (Raven 450 from Columbia Carbon Inc.) | 150 g |
| Sodium carboxymethyl cellulose (high viscosity type from Tokyo Kasei inc.) | 50.0 g |
| Benzyl alcohol | 1.5 ml |
| Distilled water added to | 1000.0 ml |

Several minutes later, formation of a dye image was observed behind the transparent base of the photographic element.

The reflection density of thus obtained dye image was measured by SAKURA PHOTOELECTRIC DENSITOMETER MODEL FIA-60 (a product of KONISHIROKU PHOTO INDUSTRY CO., LTD.) through a green filter (max=554 nm).

Thus a positive magenta dye image with Dmax of 1.83 and Dmin of 0.24 was obtained.

EXAMPLE 2

In this example, Example 1 was repeated except that in layer (4) of the photographic element, CLER Compound (27) was used in stead of CLER Compond (1). Thus a positive magenta dye image with Dmax of 1.88 and Dmin of 0.25 was obtained.

EXAMPLE 3

In this example, Example 1 was repeated except that in layer (4) of the photographic element, CLER Compound (41) was used in stead of CLER Compond (1). Thus a positive magenta dye image with Dmax of 1.85 and Dmin of 0.26 was obtained.

EXAMPLE 4

In this example, Example 1 was repeated except that in stead of the fourth and fifth layers of the photographic element the following layer was employed.

Green sensitive magenta dye image forming compound containing layer consisting of a green sensitive silver iodobromide emulsion (0.76 silver g/m$^2$), and CLER Compound (8) (0.48 g/m$^2$), benzoisoxazolone compound as an electron donor (0.37 g/m$^2$), N,N-diethyllaurylamide (1.1 g/m$^2$), and gelatin (3.6 g/m$^2$).

Thus a positive magenta dye image with Dmax of 1.85 and Dmin of 0.22 was obtained.

EXAMPLE 5

In this example, Example 4 was repeated except that in the green-sensitive magenta image forming layer of the photographic element, CLER Compound (34) was used in stead of CLER Compond (8). Thus a positive magenta dye image with Dmax of 1.90 and Dmin of 0.23 was obtained.

EXAMPLE 6

In this example, Example 4 was repeated except that in the green-sensitive magenta image forming layer of the photographic element, CLER Compound (47) was used in stead of CLER Compond (8). Thus a positive magenta dye image with Dmax of 1.86 and Dmin of 0.24 was obtained.

EXAMPLE 7

A multicolor photographic element was prepared by coating on a 150 μm thick transparent polyethylene terephthalate film support the following layers in this order:

(1) Image receiving layer containing gelatin (2.7 g/m$^2$) and poly(styrene-co-N-benzyl-N,N-dimethyl-N-methacryloylaminophenylmethylammonium chloride-co-divinylbenzene) (molar ratio: 48:48:4), (2,7 g/m$^2$);

(2) Light reflection layer containing titanium dioxide (2.2 g/m$^2$) and gelatin (2.2 g/m$^2$);

(3) Opaque layer containing carbon black (2.8 g/m$^2$) and gelatin (1.8 g/m$^2$);

(4) Cyan dye image forming compound layer containing CLER Compound (11) (0.35 g/m$^2$), benzisoxazolone compound as an electro donor (0.26 g/m$^2$), N,N-diethyllaurylamide (1.1 g/m$^2$), and gelatin (2.5 g/m$^2$);

(5) Red sensitive emulsion layer containing red sensitive silver iodobromide emulsion (0.53 g silver/m$^2$) and gelatin (0.90 g/m$^2$);

(6) Interlayer containing 2-acetyl-5-sec-octadecylhydroquinone (0.45 g/m$^2$), dibutyl phthalate (0.225 g/m$^2$) and gelatin (1.0 g/m$^2$);

(7) Magenta dye image forming compound layer containing CLER Compound (1) (0.45 g/m$^2$), benzisoxazolone compound as an electron donor (0.37 g/m$^2$), diethyllaurylamide (1.1 g/m$^2$), and gelatin (2.5 g/m$^2$);

(8) Green sensitive emulsion layer containing green sensitive silver iodobromide emulsion (0.76 g silver/m$^2$) and gelatin (1.15 g/m$^2$);

(9) Interlayer containing 2-acetyl-5-sec-octadecylhydroquinone (0.45 g/m$^2$), dibutyl phthalate (0.225 g/m$^2$) and gelatin (1.0 g/m$^2$);

(10) Yellow dye image forming compound layer containing CLER Compound (10) (0.50 g/m$^2$), benzisoxazolone compound as an electron donor (0.47 g/m$^2$), N,N-diethyllaurylamide (1.1 g/m$^2$), and gelatin (2.5 g/m$^2$); and

(12) Protective layer containing tetrakis(vinylsulfonylmethyl)methane (0.2 g/m$^2$) and gelatin (0.9 g/m$^2$).

Thuseprepared laminated multicolor photographic element was exposed as in Example 1.

A processing sheet prepared as in Example 1 was then laminated to the photographic element, together with a rupturable pod as used in Example 1 to provide a film unit.

The film unit thus prepared was pressurizingly passed through between the pair of rollers to rupture the the pod and thereby spread its contents between the photographic element and the processing sheet. 15 min. later, the optical density was measured with red, green and blue lights to obtain the following results:

| Measured area | Measurement light | | |
|---|---|---|---|
| Exposed area | 0.21 | 0.28 | 0.30 |

-continued

| Measured area | Measurement light | | |
|---|---|---|---|
| Unexposed area | 1.78 | 1.73 | 1.90 |

EXAMPLE 8

In this example, Example 7 was repeated except that CLER Compounds (37),(27) and (36) were used in layers (4), (7) and (10) respectively.

The results obtained are as follows:

| Measured area | Measurement light | | |
|---|---|---|---|
| Exposed area | 0.23 | 0.28 | 0.29 |
| Unexposed area | 1.82 | 1.75 | 1.88 |

EXAMPLE 9

In this example, Example 7 was repeaeted except that CLER Compounds (49),(41) and (48) were used in layers (4), (7) and (10) respectively.

The results obtained are as follows:

| Measured area | Measurement light | | |
|---|---|---|---|
| Exposed area | 0.23 | 0.26 | 0.30 |
| Unexposed area | 1.80 | 1.76 | 1.89 |

We claim:

1. A photographic element comprising, a silver halide photo-sensitive emulsion layer on a support, said emulsion layer containing a metal complex having a plurality of ligands, said complex being non-diffusible, inert with respect to ligand exchange until reduced under alkaline conditions (hereinafter referred to as ligand exchange inert complex) and wherein said complex has at least one polydentate group having a photographically useful group which itself is diffusible when released from said complex, said photographically useful group being selected from the group consisting of a dye, a development inhibitor, an anti-foggant, a development accelerator, a silver halide solvent, a developing agent, a toning agent, a fixing agent, a hardening agent and a precursor thereof; said complex being capable of being activated, when reduced under alkaline conditions, to become labile with respect to ligand exchange (hereinafter referred to as ligand exchange liable complex) to release said dissusible photographically useful group.

2. A photographic element according to claim 1, wherein said metal complex is represented by the general formula [I];

$$[Me(La)_p(Lb)_q(Lc)_r]Y_t$$
$$\quad\;\; X_1 \quad X_2$$

wherein Me represents a transition metal, La and Lb independently represent a polydentate group, Lc represents a mono- or poly-dentate group, $X_1$ represents a photographically useful group, $X_2$ represents a photographically useful group or a ballast group, Y represents a counter ion, p, q and r respectively represent an integer indicating the number of ligand and t represents a number as determined by the complex salt neutralization rule, provided that p is an integer of 1 to 3, q is an integer of 0 to 3 with the proviso that when q is 0, p is 2 or 3, r is an integer of 0 to 8 with the proviso that when r is 2 or more Lc may be either same or different, and t is an number of 0 to 6.

3. A photographic element according to claim 1 or 2, wherein the half value time ($t_{\frac{1}{2}}$) of ligand exchange reaction of said ligand exchange labile complex, is not greater than one-half of that of ligand exchange inert complex.

4. A photographic element according to claim 1, wherein said complex has a coordination number of 6.

5. A photographic element according to claim 1, wherein said ligand is selected from the group consisting of a (N—N) type ligand, a (O—O) type ligand, a (N—O) type ligand and a (S—S) type ligand.

6. A photographic element according to claim 1, wherein said metal is a transition metal not having a vacant inner d-orbital.

7. A photographic element according to claim 6, wherein said transition metal is selected from the group consisting of $Cr^{(III)}$, $Co^{(III)}$ and $Rh^{(III)}$.

8. A photographic element according to claim 1, wherein said metal complex is a cobalt complex.

9. A photographic element according to claim 2, wherein Me is $Co^{(III)}$, La represents a mono-valent radical derived from an ethylenediamine derivative, a B-diketone derivative, a dicarboxylic acid derivative or a salicylic acid derivative, Lb represents a mono-valent radical derived from an ethylenediamine derivative and Lc represents an ethylenediamine derivative, $X_1$ represents a group which is capable of rendering a photographically useful effect (hereinafter referred to as photographically useful group or PUG), $X_2$ represents a ballast group, p is 1, q is 1 or 2, r is 0 or 1 with the proviso that $q+r=2$, Y represents a counter anion, and t represents a number necessary to neutralize the electric charge of the $Co^{(III)}$ complex.

10. A photographic element according to claim 9, wherein said ethylendiamine derivative is represented by the following formula (II);

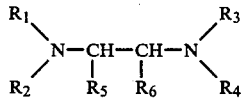

(II)

wherein $R_1$, $R_2$, $R_3$, $R_4$, $R_5$ and $R_6$ independently represents a simple bond, a hydrogen atom, an alkyl group or an aryl group, which alkyl group and aryl group may be substituted provided that when said derivative is a mono-valent radical one of $R_1$, $R_2$, $R_3$, $R_4$, $R_5$ and $R_6$ is a simple bond or a di-valent radical.

11. A photographic element according to claim 9, wherein said mono-valent B-diketone derivative is represented by the following formula (III);

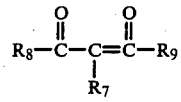

(III)

wherein $R_7$ represents a simple bond, a hydrogen atom, an alkyl group or an aryl group, $R_8$ and $R_9$ independently represent a simple bond, an alkyl group or an aryl group provided that one of $R_7$, $R_8$ and $R_9$ is a simple bond or a di-valent radical.

12. A photographic element according to claim 9, wherein said mono-valent dicarboxylic acid derivative is represented by the following formula (IV);

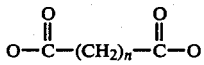

(IV)

wherein, n is an integer of 1 or 2 provided that one of the hydrogen atoms is to be substituted by the photographically useful group.

13. A photographic element according to claim 9, wherein said mono-valent salicylic acid derivative is represented by the following formula (V);

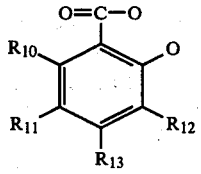

(V)

wherein, $R_{10}$, $R_{11}$, $R_{12}$ and $R_{13}$ independently represent a simple bond, a hydrogen atom, a halogen atom, a sulfo group, a cyano group, a carboxyl group, a nitro group or an alkyl group provided that one of $R_{10}$, $R_{11}$, $R_{12}$ and $R_{13}$ is a simple bond or a di-valent radical.

14. A photographic element according to claim 2, wherein said ballast group is an organic group having enough molecular disposition or weight to make the metal complex immobile in the photographic element.

15. A photographic element according to claim 14, wherein said ballast group is an organic group containing 8 to 30 carbon atoms.

16. A photographic element according to claim 14, wherein said ballast group is an organic group containing 14 to 30 carbon atoms.

17. A photographic element according to claim 1, wherein said photographically useful group is a dye or a development inhibitor, or a precursor thereof.

* * * * *

UNITED STATES PATENT AND TRADEMARK OFFICE

CERTIFICATE OF CORRECTION

PATENT NO. : 4,421,846

DATED : December 20, 1983

INVENTOR(S) : Satoru IKEUCHI et al.

It is certified that error appears in the above—identified patent and that said Letters Patent is hereby corrected as shown below:

Column 6, line 15, and
Claim 11, line 5,

"  "

should read

-- 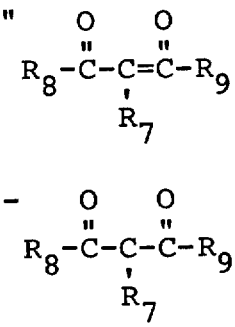 --

Claim 1, line 18, "liable" should read --labile--;

line 19, "dissusible" should read --diffusible--.

Signed and Sealed this

Twenty-fourth Day of July 1984

[SEAL]

Attest:

GERALD J. MOSSINGHOFF

Attesting Officer

Commissioner of Patents and Trademarks